US005105514A

United States Patent [19]

Bilsbury et al.

[11] Patent Number: 5,105,514

[45] Date of Patent: Apr. 21, 1992

[54] METHOD OF MAKING A LOW COST PENETRATOR PROJECTILE

[75] Inventors: Stephen J. Bilsbury, Bethlehem, Pa.; William G., Jr. Dennis, Florissant, Mo.; Stephen K. Kernosky, Godfrey, Ill.

[73] Assignee: Olin Corporation, Cheshire, Conn.

[21] Appl. No.: 627,065

[22] Filed: Dec. 13, 1990

Related U.S. Application Data

[62] Division of Ser. No. 388,178, Jul. 31, 1989, Pat. No. 5,009,166.

[51] Int. Cl.[5] ..... B21K 21/06

[52] U.S. Cl. ..... 29/1.2; 29/1.23

[58] Field of Search ..... 29/1.2, 1.21, 1.22, 29/1.23

[56] References Cited

U.S. PATENT DOCUMENTS

| | | | |
|---|---|---|---|
| 421,932 | 2/1890 | Heisler . | |
| 740,914 | 10/1903 | Platz . | |
| 1,149,602 | 8/1915 | Strange . | |
| 1,172,278 | 2/1916 | Hadfield . | |
| 1,301,859 | 4/1919 | McKenna et al. . | |
| 1,398,229 | 11/1921 | Hadfield et al. . | |
| 1,407,532 | 2/1922 | Hadfield et al. . | |
| 3,058,195 | 10/1962 | Ericsson | 29/1.21 |
| 4,246,844 | 1/1981 | Segmiller et al. | 29/1.2 X |
| 4,619,203 | 10/1986 | Habbe . | |
| 4,774,745 | 10/1988 | Carter | 29/1.2 X |

*Primary Examiner*—Timothy V. Eley
*Attorney, Agent, or Firm*—John R. Wahl

[57] ABSTRACT

A low cost penetrator projectile is disclosed having a hard metal penetrator core with a generally hollow conical shape. The core is formed from low carbon steel in a series of progressive dies. The formed cores are then carburized and tempered to achieve a final Rockwell hardness of between about C50 and C55.

7 Claims, 1 Drawing Sheet

METHOD OF MAKING A LOW COST PENETRATOR PROJECTILE

This invention was made with government support under Contract No. DAAA21-86-C-0333 awarded by the U.S. Army. The Government has certain rights in this invention.

This application is a division of application Ser. No. 388,178, filed Jul. 31, 1989, now U.S. Pat. No. 5,009,166.

This invention relates to ammunition projectiles and more particularly to a projectile having a hard metal penetrator cone shaped penetrator core.

A penetrator core must be sufficiently hard to prevent the core from plastically deforming upon impact. However, the core must not be too brittle or it will fracture or even shatter upon impact. These requirements dictate the use of an extremely hard metal stock material To contain costs, a high plain carbon steel is often used.

Conventional cone shaped penetrator projectile cores, particularly the 5.56 mm bullet core, are solid cores and are currently manufactured by individually cold heading each core from wire stock. Automatic screw machining may also be used to form the cores from rod stock. However, the cold heading manufacturing process is presently the cheapest method employed in production of small caliber hard penetrator cores.

The progressive die shaping process, which involves sequentially forming a hollow metal body from sheet metal stock in a series of progressively sized die sets, has been particularly successful in the formation of shotshell heads. This process, however, has not heretofore been adapted to the formation of extremely hard penetrator cores because of the potential accelerated wear on tooling from the hard metal stock.

It is desirable to find a more economical way to manufacture a penetrator core for this bullet in larger numbers and for a reduced cost. However, as stated previously, the metal of the penetrator is extremely hard, on the order of a Rockwell hardness number of C50–C55. Conventional stamping processes are not adaptable to a high volume production rate of penetrator cores of this hardness.

It is therefore an object of the present invention to provide a method for producing hardened projectile cores at a high rate.

It is another object of the present invention to adapt a progressive die production process to produce low cost penetrator cores.

It is still further object of the present invention to adapt a progressive die formation system to produce a multiplicity of hollow cone penetrator cores for production of low cost penetrator projectiles.

These and other objects, features, and advantages of the present invention will become more apparent in view of the following detailed description when taken in conjunction with the drawings and appended claims.

Figure 1:
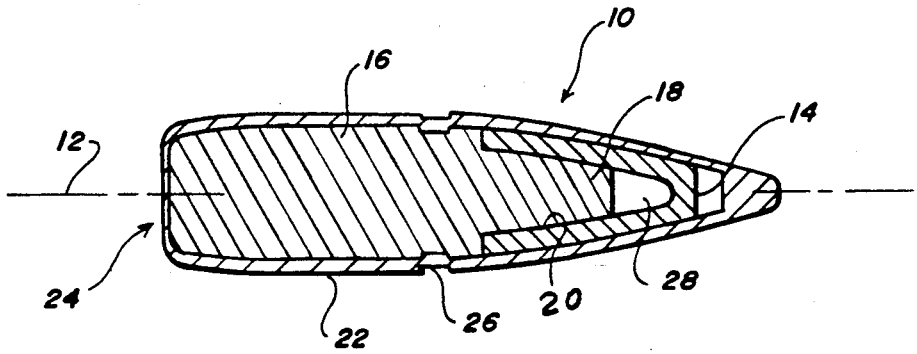
Figure 2:
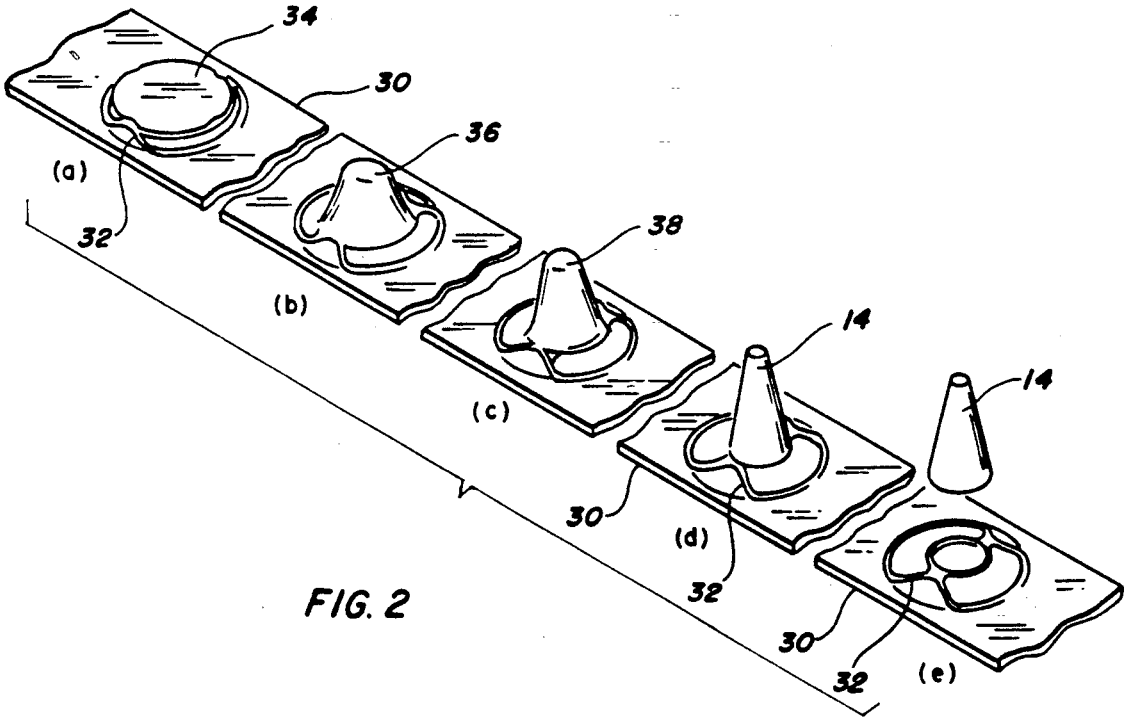

FIG. 1 is a cross-sectional view of a penetrator projectile incorporating a hollow cone penetrator core in accordance with the present invention; and FIG. 2 is a partial perspective view of a strip of steel showing the progressive die stamping/drawing process used to create the hollow cone penetrator core shown in FIG. 1.

A low cost penetrator projectile 10 produced in accordance with the present invention is shown in cross-section in FIG. 1. The projectile 10 is symmetrical about axis 12 and comprises a hollow metal penetrator core 14 having a generally frustoconical shape. A lead body 16 having a front portion 18 extends into a hollow portion 20 of the core 14 and a copper alloy metal jacket 22 is formed over the core 14 enclosing core 14 and at least a portion of the lead body 16. The rear end 24 of projectile 10 may be open to the lead body 16 or may be closed, as shown in FIG. 1. A cannelure 26 may be formed in the jacket 22 to retain the assembled projectile in a cartridge case (not shown) as is conventionally known.

The lead body 16 may be poured in place within or preferably swaged into the rear of the penetrator core 14 so as to preferably completely fill the hollow portion 20 of penetrator 14. Alternatively, a cavity 28 may be permitted between the front end portion 18 of body 16 within the hollow portion 20 of penetrator 14.

The hardness of the penetrator core must be sufficient to prevent the penetrator core from deforming plastically upon impact. However, the core cannot be too hard or it becomes too brittle and will fracture or shatter upon impact with a hard object such as armor plate. If made of low carbon steel, the core must be hardened appropriately. An optimum hardness range for the hard steel penetrator core 14 made from mild steel is between Rockwell C50 and C55 when measured according to ASTM Standard Test Method E92–57. A preferable hardness value for the penetrator according to the present invention is about C53.

The penetrator core 14 is formed from low carbon steel according to the present invention in a progressive die set stamping process. The penetrator core formation in the progressive die set is illustrated in FIG. 2. The process preferably includes the steps of:

a) providing at least one strip 30 of low carbon steel;

b) forming, in a series of progressive dies, at least one portion of the strip into the cone shaped core 14 attached to the strip 30 by a web portion 32 as shown in FIG. 2 (*a*), (*b*), (*c*) and (*d*);

c) clipping the core 14 from the web portion 32 of the strip as in FIG. 2 (*e*);

d) carburizing the core 14 to the specific desired hardness, between about C50–C55 using conventional carburizing techniques.

More particularly, the forming step b) above includes blanking a disk shaped core blank 34 in the strip 30 in a first die set which leaves the blank 34 attached to the strip 30 by the web portion 32 about the blank 34. The blank 34 is then cupped in at least one second progressive die set. Sequential second and third cuppings may also be made in progressively longer cupping die sets to yield a cup shaped blank 36 having almost a conical shape. The use of several sequential cupping die sets further reduces the wear on the dies.

The cup shaped blank 36 is then drawn further in at least one third progressive die set into an elongated shaped blank 38. The blank 38 is then shaped into a conically shaped blank in a fourth progressive die set and may be headed in the same or another progressive die set to a truncated cone shaped core 14 shape as in FIG. 2(*d*). Finally, the truncated conical shaped core 14 is clipped (*e*) from the strip web 32.

After clipping, the cores 14 are then carburized at a temperature within the range of from about 1650° F. to about 1750° F. to ensure that the metal is well into the austinite range. The cores are carburized to a level of about 0.90% to about 1.05% by weight carbon and long enough to ensure complete diffusion of the carbon atoms into the steel. The cores are then cooled at a sufficiently rapid rate to achieve Rockwell hardness of about C65. Finally, the cores are then tempered to a final desired hardness between C50 and C55, preferably about C53.

Each of the progressive die sets may have a plurality of complementary dies and be arranged to operate simultaneously on multiple strip blanks, producing multiple cores at the same time. For example the strip may be wide enough so that the multiple sets can produce a number of cores 14 in parallel as the strip is advanced. The die sets are preferably staggered so as to operate together to more fully utilize the strip material when they progressively form the cores as the strip is passed through the dies.

The preferred forming step includes:

a) blanking at least one disk shaped penetrator core blank 34 in the strip of low carbon steel 30 in a first progressive die set so that the blank 34 remains attached to the strip 30 by at least one web portion 32;

b) cupping the blank 34 into a conically shaped core in at least one second progressive die set; and c) heading the core to form the truncated cone shaped penetrator core 14 in at least one other progressive die set.

The cupping step may be further comprised of the steps of:

a) cupping the blank 34 into a cup shaped blank 36 an at least one second progressive die set;

b) drawing the cup shaped blank 36 into an elongated shaped blank 38 in at least one third progressive die set; and c) shaping the elongated shaped blank 38 into a generally conically shaped blank in at least one fourth progressive die set.

Thus in the method according to the present invention, the penetrator core is simply manufactured by progressive die shaping a blank into the core shape which partially hardens the low carbon steel of the core, carburizing the cores to a generally uniform hardness exceeding the desired final hardness, and then tempering the cores to achieve a uniform hardness of the desired value, between C50 and C55.

This method has been found to allow factory workers to produce penetrator cores at about 3 times the maximum through capacity as previously achievable using conventional machining techniques, thus reducing labor costs. Accordingly, the cost of production is lower and therefore more cost effective. As the core is currently the most expensive component of the penetrator projectile, the end result is a penetrator projectile produced at a substantially reduced cost.

Although the invention has been described with a certain degree of particularity, it is understood that the present disclosure has been made only be way of example and that numerous changes in the details of construction steps and the combination and arrangement of steps may be resorted to without departing from the spirit and scope of the invention.

What is claimed is:

1. A method of forming a hollow cone penetrator core for a penetrator projectile comprising the steps of:

a. providing a strip of low carbon steel;

b. forming at least one portion of said strip into a cone shaped core attached to said strip by a web portion of said strip in a series of progressive dies;

c. clipping said formed core from said web portion of said strip; and d. carburizing said core.

2. The method of claim 1 wherein said step of forming further comprises the steps of:

a. blanking at least one disk shaped core blank in said strip of low carbon steel in a first progressive die set, said blank remaining attached to said strip by at least one web portion;

b. cupping said blank into a cone shaped core blank in at least one second progressive die set;

c. heading said core blank to form a truncated cone shaped penetrator core in at least one other progressive die set.

3. The method of claim 2 wherein said step of cupping further comprises the steps of:

a) cupping said blank into a cupped shape blank in at least one second progressive die set;

b) drawing said cupped shape blank into an elongated shaped blank in at least one third progressive die set; and c) shaping said elongated shaped blank into a generally conically shaped core blank in at least one fourth progressive die set.

4. The method of claim 2 wherein said step of carburizing said core hardens said core to a Rockwell hardness of C50 to C55.

5. The method of claim 4 wherein said step of carburizing said core further comprises the steps of:

a. carburizing said core at a temperature of about 1700° F. to a level of about 1% carbon by weight and a Rockwell hardness of about C65; and b. tempering said core to a Rockwell hardness of between C50 and C55.

6. The method of claim 5 wherein said core is hardened to a Rockwell hardness of about C53.

7. The method according to claim 6 wherein each of said progressive die sets operates on a plurality of blanks simultaneously so as to produce multiple penetrator cores simultaneously.

* * * * *